US007767263B2

(12) United States Patent
Tang

(10) Patent No.: US 7,767,263 B2
(45) Date of Patent: Aug. 3, 2010

(54) METHOD OF MANUFACTURING A MOULD PART

(75) Inventor: Peter Torben Tang, Søborg (DK)

(73) Assignee: Danmarks Tekniske Universitet, Kongens Lyngby (DK)

( * ) Notice: Subject to any disclaimer, the term of this patent is extended or adjusted under 35 U.S.C. 154(b) by 600 days.

(21) Appl. No.: 11/662,407

(22) PCT Filed: Sep. 5, 2005

(86) PCT No.: PCT/DK2005/000564

§ 371 (c)(1),
(2), (4) Date: Mar. 9, 2007

(87) PCT Pub. No.: WO2006/026989

PCT Pub. Date: Mar. 16, 2006

(65) Prior Publication Data

US 2007/0298173 A1 Dec. 27, 2007

(30) Foreign Application Priority Data

Sep. 10, 2004 (DK) ..... 2004 01375

(51) Int. Cl.
*B44C 1/22* (2006.01)

(52) U.S. Cl. ..... 427/331; 216/67; 216/83; 216/37; 252/79; 205/118; 205/170

(58) Field of Classification Search ..... 216/67; 252/79; 205/118
See application file for complete search history.

(56) References Cited

U.S. PATENT DOCUMENTS

| | | | | |
|---|---|---|---|---|
| 3,939,046 | A | 2/1976 | Conn et al. | |
| 2003/0090030 | A1 | 5/2003 | Ferguson et al. | |
| 2004/0065550 | A1 * | 4/2004 | Zhang | 205/118 |

FOREIGN PATENT DOCUMENTS

| | | | |
|---|---|---|---|
| DE | 26 25 869 | A1 | 12/1977 |
| DE | 40 24 909 | A1 | 2/1992 |
| JP | 2003-334819 | A | 11/2003 |

* cited by examiner

*Primary Examiner*—Nadine Norton
*Assistant Examiner*—Maki Angadi
(74) *Attorney, Agent, or Firm*—Jerald L. Meyer; Derek Richmond; Stanley N. Protigal

(57) ABSTRACT

A method of manufacturing a mould part (8) for forming an article. The method comprises: providing a master (1) of an aluminium alloy or a zinc alloy with a surface (7) corresponding to the surface of the article to be formed by the mould part. A copper layer (3) is deposited on top of the master surface (7). Then a mould part layer (4) of nickel, a nickel alloy, cobalt or a cobalt alloy is plated on top of the copper layer. The master (1) is dissolved in a solution. The copper layer (3) is selectively etched from the mould part layer (4) in an alkaline etchant comprising free Cu(II) ions, a first complexing agent forming strong complexes with Cu(I) ions but not Ni ions or Co ions, a second complexing agent forming strong complexes with Cu(II) ions but not Ni ions or Co ions. Oxygen is supplied to the etchant for oxidizing Cu(I) ions to Cu (II) ions.

15 Claims, 1 Drawing Sheet

METHOD OF MANUFACTURING A MOULD PART

TECHNICAL FIELD

The invention relates to a method of manufacturing a mould part for forming an article.

BACKGROUND ART

Mould parts, inserts or dies for forming articles are used in many different processes, such as injection moulding, blow moulding, hot pressing, stamping, thermoforming, embossing, coining or printing, etc. The mould part can be manufactured in many different ways. It can be milled from a solid member of metal or other material. Another method is to manufacture the mould by electroforming. A master with the shape of the article to be manufactured by the mould is provided. The master can be of an electrically conductive material or be provided with a surface of an electrically conductive material. A relatively thick "mould layer" of metal is electroplated on the surface of the master. The master is then removed, e.g. by dissolving, and the electrodeposited metal layer can be used as a mould part for forming articles with the same shape as the master. The metal mould layer can also be deposited by autocatalytic plating, also known as electroless plating. Electroless plating is a plating process including the step of deposition but without the application of current. The process is a chemical reaction and is autocatalytic. The master can be made of aluminium which is easy to machine to the desired form and easy to remove by etching. Being easy to plate and hard, i.e. a good wear resisting material, nickel is often chosen for mould parts made by electroforming. Cobalt has very similar characteristics and is also suitable. Normally, the mould layer is backed with another material, e.g. further metal plating to provide sufficient rigidity and thermal conductivity.

US 2003/0090030 A1 discloses the machining of a master in aluminium and the electroplating of same in a nickel bath to provide a mould part.

Furthermore, it is known to remove the aluminium master by dissolving the aluminium in an alkaline solution. Aluminium can be dissolved by an alkaline solution comprising hydroxide such as NaOH without dissolving any nickel or cobalt. Thus, a perfect surface representing the reverse image of the master is left when the aluminium has been dissolved. However, this requires that the master is made of completely pure aluminium. Pure aluminium is not suitable for chip-producing processing as long chips are produced. Aluminium alloys suitable for machining comprise alloy elements, such as Cu, Mn, Si, Mg, Zn, Sn, to improve different properties, e.g. machining properties. However, several of these alloying elements form oxides which are not easily removed by the alkaline solution. In order to remove these oxides or other chemical combinations comprising these alloying elements, more aggressive solutions must be used. In most cases, these aggressive solutions will etch or dissolve some of the nickel or cobalt resulting in a mould part with a surface which is not a perfect reverse image of the master. In addition, environmental considerations must to be taken into account when using aggressive solutions.

Alternatively, a zinc alloy can be used as a material for the master. Like aluminium, zinc can be dissolved in an alkaline solution.

DESCRIPTION OF THE INVENTION

The object of the invention is to provide an improved method of making a mould part, in which the surface of the mould part is a perfect reverse image of the article to be manufactured by the mould part, and which method provides environmental advantages compared to known methods.

According to the invention a method of making a mould part for forming an article is provided, said method comprising:

- providing a master of an aluminium alloy or a zinc alloy with a surface corresponding to the surface of the article to be formed by the mould part,
- depositing a copper layer on top of the master surface,
- plating a mould part layer of nickel, a nickel alloy, cobalt or a cobalt alloy on top of the copper layer,
- dissolving the master in a solution,
- selective etching the copper layer from the mould part layer in an alkaline etchant comprising free Cu(II) ions, a first complexing agent forming strong complexes with Cu(I) ions but not Ni ions or Co ions, a second complexing agent forming strong complexes with Cu(II) ions but not Ni ions or Co ions, and where oxygen is supplied to the etchant for oxidizing Cu(I) ions to Cu (II) ions.

Depositing a copper layer on top of the master prior to the nickel plating, all oxides and other chemical combinations formed by the alloying elements of the aluminium alloy or the zinc alloy are left on the surface of the copper deposition and is removed with the copper in the alkaline etchant. As the alkaline etchant does not dissolve nickel, a perfectly shaped and clean surface for moulding articles is obtained. This perfectly shaped surface is a great advantage, when the mould part is used for forming high precision parts. No dangerous chemicals, such as cyanide based alkaline solutions are needed. Use of solutions based on peroxide, such as mixtures of sulphuric acid or ammonia with peroxide, which are unstable and difficult to use, are avoided.

The invention solves, in particular, problems with aluminium alloys with a content of aluminium less than 99% by weight and zinc alloys with a content of zinc less than 99% by weight.

According to an embodiment of the invention the first complexing agent comprises chloride ions from compounds, such as NaCl, $NH_4Cl$ or KCl.

The second complexing agent is e.g. ammonia.

According to a preferred embodiment the etchant comprises a pH buffer, such as $NaHCO_3$, to maintain the pH value within the range 7-11, preferably 8-10, most preferably 8.5-9.5. The pH buffer maintains the etchant at a pH value, where the nickel or the cobalt is not attacked.

According to a further embodiment the oxygen is supplied to the etchant by pumping pure oxygen, atmospheric air or a mixture hereof through the solution. This is a very simple way of providing an oxidizer to the etchant.

According to a preferred embodiment the master is made of an aluminium alloy, and the master surface is zincated prior to the copper deposition process. Zincating is a process of depositing a thin zinc layer on the aluminium surface. The zinc layer does not form a protective oxide layer as rapidly as aluminium and is therefore a better basis for further surface treatments.

The copper deposition process is preferably electroplating from an alkaline copper bath, especially a copper pyrophosphate bath. A copper pyrophosphate bath is an environment-friendly bath and is very suitable for plating on zinc, as the zinc layer can survive in the mildly alkaline bath until it is completely covered with copper. A copper layer deposited from the copper pyrophosphate bath also has the advantage that small scratches and other defects in the aluminium surface are smoothened prior to plating the mould layer. However, other copper baths have smoothening properties and are capable of replacing the copper pyrophosphate bath.

Alternatively, it is possible to deposit the copper layer by other methods, e.g. by chemical vapour deposition (CVD) or physical vapour deposition (PVD).

Typically, a copper layer of 1-10 μm is deposited on the aluminium surface.

Preferably, the master is dissolved in an alkaline solution, e.g. comprising NaOH or KOH. The solution is typically heated to about 60° C. and agitated to accelerate the dissolving rate. However, other alkaline solutions can also be used.

The method according to the invention can be used for forming a mould part intended for moulding, embossing, coining or printing components with integrated microfluidic channels or components with optical properties. As the method is capable of providing very precise mould parts, it is particularly suitable for making mould parts for moulding high precision articles, such as "lab-on-a-chip" articles or articles with optical properties.

According to the invention channels in the surface of the master are mechanically milled by a milling tool with a diameter less than 1 mm. Using milling tools with a diameter less than 1 mm, e.g. 9.2 mm or even 0.1 mm, and a CNC milling machine, a very precise master can be obtained.

BRIEF DESCRIPTION OF THE DRAWING

The present invention will be further elucidated in the following by way of an example, and with reference to the drawing, in which.

BEST MODES FOR CARRYING OUT THE INVENTION

Step 1: Machining a Master

Being easily dissolved, aluminium is chosen as master material. Aluminium alloys are classified by the internationally accepted classification system shown in Table 1.

TABLE 1

| Series | Alloy |
|---|---|
| 1XXX | Aluminium of 99% minimum purity |
| 2XXX | Aluminium-copper alloys |
| 3XXX | Aluminium-manganese alloys |
| 4XXX | Aluminium-silicon alloys |
| 5XXX | Aluminium-magnesium alloys |
| 6XXX | Aluminium-magnesium-silicon alloys |
| 7XXX | Aluminium-zinc-magnesium alloys |
| 8XXX | Miscellaneous alloys |

Pure aluminum from the 1XXX series is very soft and often not suitable for tooling due to the production of long chips. Even so-called pure aluminium from the 1XXX series comprises impurities which forms oxides that are not as easily dissolved as aluminium. In the experiments described in the following, the 6063 alloy is chosen. This 6063 alloy is one of the most widely used aluminium alloys and comprises the alloying elements and impurities shown in Table 2.

TABLE 2

| Element | Minimum at. % | Maximum at. % |
|---|---|---|
| Si | 0.2 | 0.6 |
| Fe | — | 0.35 |
| Cu | — | 0.1 |
| Mn | — | 0.1 |
| Mg | 0.45 | 0.9 |
| Cr | — | 0.1 |
| Zn | — | 0.1 |
| Ti | — | 0.1 |
| Others | — | 0.15 |

Cu, Mn and Fe form brown or black oxides. Even a small amount of these elements in the alloy are problematic, as the master to be dissolved is large, thus containing large amounts of these elements.

Figure 1:
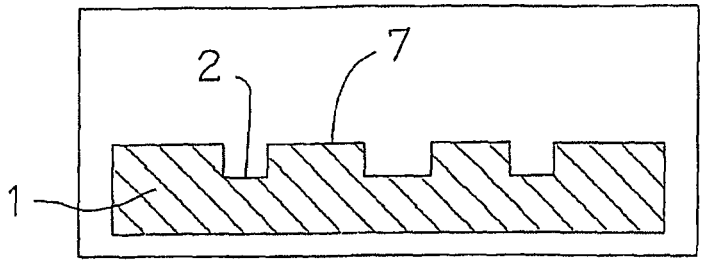
FIG. 1 shows an aluminium master with channels milled in the surface.

The master 1 is provided by cutting a plate of aluminium alloy to the desired size. The thickness of the plate is 1-10 mm. The surface 7 of the master 1 is machined by milling using a CNC machine. Small milling tools with a diameter down to 0.2 mm are used to mill small channels 2 in the surface. However, the master surface can alternatively be provided with microstructures by laser machining, spark machining (Electrodischarge machining or EDM) or by chemical or electrochemical etching through a mask or a photoresist. A machined master is shown schematically in FIG. 1.

Step 2: Depositing a Copper Layer

Cutting oil, grease and dirt are removed by cathodic degreasing for 2-3 minutes in an alkaline degreasing solution comprising cyanide at room temperature and 4 Volt. Subsequently, the master is pickled for 5-10 seconds in a sodium hydroxide solution comprising 60 g NaOH per litre water at 60° C. The pickling process removes the oxide layer. If burrs are to be removed, the pickling can be carried out for a longer time but this may remove sharp edges. After the pickling, the master is activated in 30% concentrated nitric acid for 15 seconds at room temperature. Due to the content of Si, 20 g/l ammonium fluoride ($NH_4F$) is added to the active bath in order to work properly.

The activated master is hereafter zincated. A commercially available zincating bath "Alugal" can be used for 20 seconds at room temperature. By the zincating process, a very thin layer of zinc is deposited on the aluminium surface by a kind of ion exchange plating. The zinc layer does not form a protecting oxide layer as rapidly as aluminium and is therefore a better basis for further surface treatments.

After the zincating process, a copper layer 3 is deposited from a copper pyrophosphate bath with the composition shown in Table 3.

TABLE 3

Figure 2:
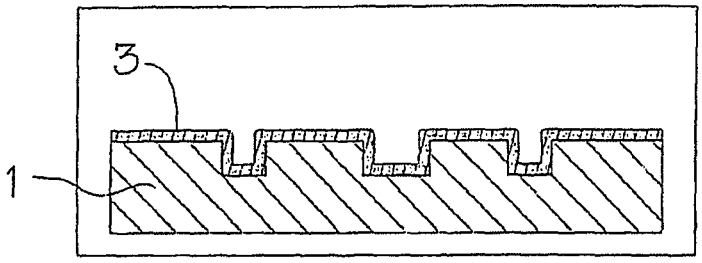
FIG. 2 shows the master after deposition of a copper layer.

| Name | Formula | Concentration |
|---|---|---|
| Copper pyrophosphate | $Cu_2P_2O_7 \cdot 3H_2O$ | 90 g/l |
| Potassium pyrophosphate | $K_4P_2O_7$ | 350 g/l |
| Potassium hydrogen phosphate | $K_2HPO_4$ | 80 g/l |
| Potassium nitrate | $KNO_3$ | 15 g/l |
| Ammonia | $NH_4OH$ | 2 ml/l |

pH is adjusted to about 9.0 by adding phosphoric acid. The temperature is about 55° C. and about 5 μm copper is plated. In FIG. 2 the master 1 with the copper layer 3 is shown.

Step 3: Electroforming a Mould Part Layer

Figure 3:
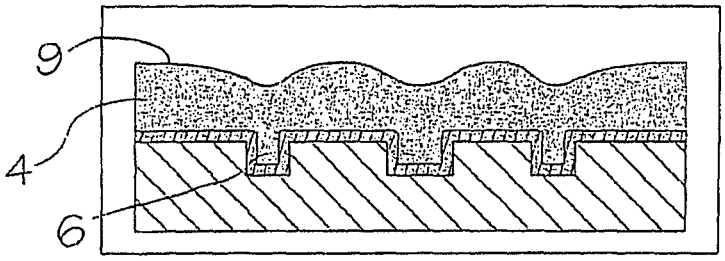
FIG. 3 shows the master after plating a nickel mould part layer.

Immediately after the copper deposition step, a mould part layer 4 is plated on the copper layer 3, see FIG. 3. The material deposited in the beginning of the plating process becomes the surface of the finished mould part. It is therefore important that this material has a good wear resistance, i.e. it must be hard. Suitable materials are nickel, nickel alloys, cobalt and cobalt alloys. Nickel plated in a nickel sulphamate electroforming process is suitable. Furthermore, plating of nickel, cobalt, nickel alloys or cobalt alloys in an electrodepositing bath with pulsating current is suitable, cf. U.S. Pat. No. 6,036,833. Suitable nickel alloys are NiCo, NiFe, NiCu, NiW or NiMo. Very hard nickel alloys can be obtained by using an autocatalytic nickel bath. A direct current can be added to accelerate the deposition. Using autocatalytical nickel plating, the following alloys can be obtained: NiP, NiPX, NiB or NiBX wherein X can be Co, Fe, Cu, Mo, W, etc. In some cases, it might be desirable to plate more than one layer. A first layer of nickel is a wear layer. The next layer plated on top of the nickel layer can be a layer with good heat conductivity, such as copper or a copper alloy. The heat conductivity of nickel is relatively poor. If the mould part is to be used in injection moulding, good heat conductivity properties for the mould parts is desirable in order to reduce the cycle time. The mould part layer formed is typically between 0.2 and 5 mm thick. The thickness, naturally, depends on size and type of mould part. Furthermore, the mould part can be backed by materials, such as curable substances providing a strong support of the rear side of the mould part. FIG. 3 shows how the channels 2 in the master surface are filled with the mould material by the plating process.

Step 4: Machining the Plated Mould Part Layer

Figure 4:
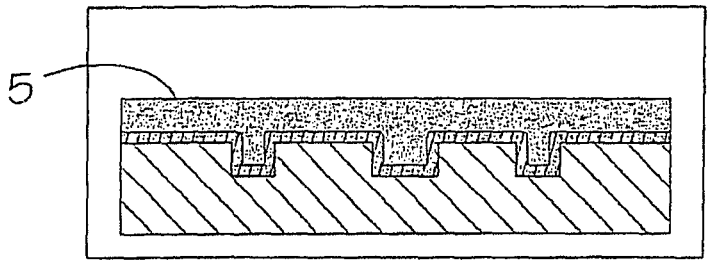
FIG. 4 shows the nickel mould part layer after trimming the rear side by surface milling, FIG. 5 show the nickel mould part layer and the copper layer after the dissolving of the aluminium master.

After plating the mould part layer 4, it is machined to the desired dimensions. It is advantageous to machine the mould part before the master is dissolved, as described under Step 5. The fine and vulnerable surface structure or texture of the mould part layer is well protected by the master 1 during the machining. Typically, the rear side 9 of the mould part layer, the upper side in FIG. 3, is face planed due to the unevenness of the mould part layer after the plating process. FIG. 4 discloses the rear side 5 of the mould part layer after face planing. Also, the circumferential edges of the mould part are cut to the desired shape and dimensions. When the opposite side of the master 1, the lower side in FIG. 4, is used as reference, the desired thickness of the mould part can easily be obtained. In this way, it is also possible to ensure that the two sides of the finished mould part become plan-parallel.

Step 5: Dissolving the Master

Figure 5:
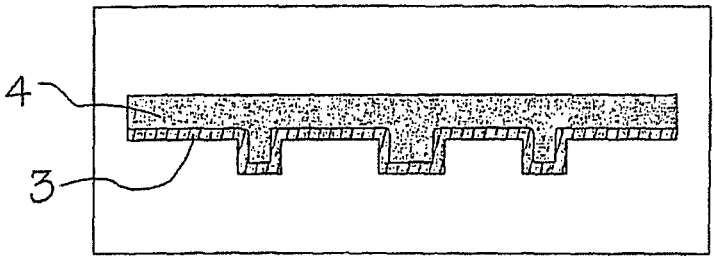

Cutting oil, grease and dirt are removed by cathodic degreasing for 2-3 minutes in an alkaline degreasing solution comprising cyanide at room temperature and 4 Volt. Subsequently, the master is etched in a sodium hydroxide solution comprising 60 g NaOH per litre water at 60° C. This is the same treatment as the pickling process in Step 2 but for a much longer time. Depending on the agitation and the ratio between the liquid volume and the master surface area, it typically takes 12-48 hours to remove 4 to 8 mm aluminium. Manganese oxides and possibly other oxides can be reduced by dipping the master with the copper layer in a solution comprising the reducing agent hydroxylamine hydrochloride ($NH_2OH.HCL$) for 5 minutes at room temperature. FIG. 5 shows the mould part layer 4 and the copper layer 3 after the master is dissolved.

Step 6: Selective Etching of the Copper Layer

The copper layer on the aluminium master is selectively etched in the solution shown in Table 4.

TABLE 4

| Name | Formula | Concentration |
|---|---|---|
| Sodium Chloride | NaCl | 75 g/l |
| Sodium hydrogen carbonate | $NaHCO_3$ | 100 g/l |
| Copper hydroxycarbonate | $CuCO_3 \cdot Cu(OH)_2$ | 1 g/l |
| Ammonia | $NH_4OH$ (25%) | 150 ml/l |
| Hydrochloric acid | HCL (2 mol/l) | pH 9.5 (about 50 ml/l) |

In ammonia solutions the following reaction takes place:

$$Cu^0 + Cu^{2+} \Leftrightarrow 2Cu^+$$

This equilibrium is displaced to the right, as the equilibrum constant is $$k = \frac{[Cu(NH_3)_4^{2+}]}{[Cu(NH_3)_4^{+}]^2} = 9.3 \cdot 10^{-3}$$

The concentration af ammonia complexes with $Cu^+$, which are colourless, is about 10 times higher than the concentration of ammonia complexes with $Cu^{2+}$, which are blue. The concentration of blue $Cu^{2+}$ ammonia complexes in the solution can be measured by measuring the colour saturation with a spectrophotometer. In this way, the system can be monitored as the solution during use will contain more and more copper.

Copper forms complexes with both ammonia and chloride. The ammonia complexes are described above. The most stable of the chloride complexes is $CuCl_2^-$, in which the oxidation number for copper is +1. Thus, the content of chloride in the etchant shifts the equilibrium to the right.

The content of sodium hydrogen carbonate stabilizes the pH value of the solution. The pH value is adjusted to 9.5 at the beginning of the process by adding HCl and is fairly stable during the process. However, the pH value tends to drop slightly and stabilize at about 8.5-9.

The small amount of copper hydroxycarbonate, cf. Table 4, is added to provide a start concentration of Cu(II) ions. Without these ions, the reaction disclosed above would not take place. Adding copper hydroxycarbonate, the solution works optimally immediately after mixture of the solution. A start concentration of Cu(II) ions can, however, be provided in many different ways.

Figure 6:
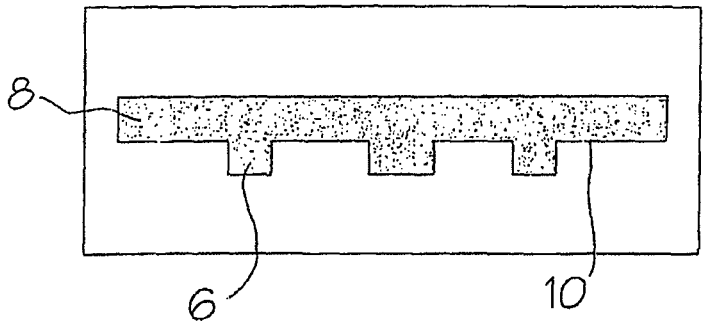
FIG. 6 shows the nickel mould part after selective etching of the copper layer.

This solution shown in Table 4 is so mild with regard to the pH value that it does not attack nickel or cobalt. Neither is it problematic to the working environment or the aquatic environment. The etching takes place at room temperature. If the temperature is elevated to about 40° C., the etching process will be accelerated. During the process, atmospheric air is pumped through the solution. As a result, Cu(I) ions are oxidized to Cu(II) ions, and at the same time the solution is agitated, thus carrying fresh solution to the surface of the copper layer. The air can be pumped from a pump through glass tubes and a fritted glass bubbler arranged beneath the article. An etching rate of about 5 μm per hour is normal at room temperature, but is variable, depending on the set-up and the character of the etchant. During the etching, the copper layer and other oxides formed by the alloying elements of the aluminium master are removed without any etching or dissolving of the nickel mould part layer. Thus, a mould part 8 with a surface 10, which is a perfect reverse image of the aluminium master surface 7 is obtained, cf. FIG. 6. This mould part can be used to mould perfect clones of the aluminium master.

The invention is not limited to the above described process. The intermediate steps of zincating, pickling etc. are not necessary in all cases. Furthermore, some of these intermediate steps can be replaced by other steps providing the same or a similar effect.

The method according to the invention is particularly suitable for the manufacturing of high precision mould parts, the master material being completely removed without any of the mould material being removed. Even if the master surface contains fine patterns of small channels and the like, a perfect reverse image is obtained.

In the example described above, the master is made of an aluminium alloy. However, a zinc alloy is also suitable as master material, zinc alloys being easy to machine and capable of being dissolved in an alkaline solution, such as a solution comprising NaOH and/or KOH. Typical zinc alloys comprise Al, Cu, Fe, Mg, Pb and Sn.

The invention claimed is:

1. A method of manufacturing a mould part (8) for forming an article, said method comprising:

providing a master (1) of an aluminium alloy or a zinc alloy with a surface (7) corresponding to the surface of the article to be formed by the mould part, depositing a copper layer (3) on top of the master surface (7), plating a mould part layer (4) of nickel, a nickel alloy, cobalt or a cobalt alloy on top of the copper layer, dissolving the master (1) in a solution, selective etching the copper layer (3) from the mould part layer (4) in an alkaline etchant comprising free Cu(II) ions, a first complexing agent forming strong complexes with Cu(I) ions but not Ni ions or Co ions, a second complexing agent forming strong complexes with Cu(II) ions but not Ni ions or Co ions, and where oxygen is supplied to the etchant for oxidizing Cu(I) ions to Cu (II) ions.

2. A method according to claim 1, wherein the first complexing agent comprising chloride ions from compounds such as NaCl, $NH_4Cl$ or KCl.

3. A method according to claim 1, wherein the second complexing agent is ammonia.

4. A method according to claim 1, wherein the etchant comprises a pH buffer to maintain the pH value within the range 7-11.

5. A method according to claim 1, wherein the oxygen is supplied to the etchant by pumping pure oxygen, atmospheric air or a mixture hereof through the solution.

6. A method according to claim 1, wherein the master is made of an aluminium alloy, and the master surface (7) is zincated before the copper deposition process.

7. A method according to claim 1, wherein the copper deposition process is electroplating from a copper pyrophosphate bath.

8. A method according to claim 1, wherein the master is dissolved in an alkaline solution.

9. A method according to claim 1, for forming a mould part (8) intended for moulding, embossing, coining or printing components with integrated microfluidic channels (2) or components with optical properties.

10. A method according to claim 9, wherein channels in the surface (7) of the master is mechanically milled by a milling tool with a diameter of less than 1 mm.

11. A method according to claim 4, wherein the etchant comprises a pH buffer to maintain the pH value within the range 8-10.

12. A method according to claim 4, wherein the etchant comprises a pH buffer to maintain the pH value within the range 8.5-9.5.

13. A method according to claim 4, wherein the pH buffer is $NaHCO_3$.

14. A method according to claim 1, wherein the copper deposition process is electroplating from an alkaline copper bath.

15. A method according to claim 8, wherein the alkaline solution comprises NaOH and/or KOH.

* * * * *